US008350778B2

(12) United States Patent
Yeh

(10) Patent No.: US 8,350,778 B2
(45) Date of Patent: Jan. 8, 2013

(54) ADJUSTMENT METHOD FOR DISH ANTENNA

(75) Inventor: Chao Chun Yeh, Hsinchu (TW)

(73) Assignee: Microelectronics Technology Inc., Hsinchu (TW)

( * ) Notice: Subject to any disclaimer, the term of this patent is extended or adjusted under 35 U.S.C. 154(b) by 732 days.

(21) Appl. No.: 12/539,173

(22) Filed: Aug. 11, 2009

(65) Prior Publication Data

US 2010/0201599 A1 Aug. 12, 2010

(30) Foreign Application Priority Data

Feb. 12, 2009 (TW) ..... 98104425 A

(51) Int. Cl.
*H01Q 3/02* (2006.01)
*H01Q 1/12* (2006.01)
*H01Q 1/08* (2006.01)

(52) U.S. Cl. ..... 343/882; 343/878; 343/880

(58) Field of Classification Search ..... 343/882, 343/878, 880, 890, 892
See application file for complete search history.

(56) References Cited

U.S. PATENT DOCUMENTS

| | | | | |
|---|---|---|---|---|
| 4,649,675 | A * | 3/1987 | Moldovan et al. | 52/27 |
| 5,576,722 | A * | 11/1996 | Bustillos | 343/882 |
| 6,445,361 | B2 * | 9/2002 | Liu et al. | 343/882 |
| 6,762,731 | B1 | 7/2004 | Chou | |
| 7,268,743 | B2 * | 9/2007 | Lin | 343/880 |
| 2001/0045912 | A1 | 11/2001 | Liu et al. | |

FOREIGN PATENT DOCUMENTS

| | | |
|---|---|---|
| CN | 1825705 A | 8/2006 |
| CN | 1825706 A | 8/2006 |
| TW | 465812 | 11/2001 |
| TW | M249230 | 11/2004 |

OTHER PUBLICATIONS

Office action issued Jun. 26, 2012 from counterpart CN application No. 200910009214.4 cites CN 1825705A and 1825706A.
English abstract of Office action issued Jun. 26, 2012 from counterpart CN application No. 200910009214.4.
English abstract of CN 1825705A and 1825706A.
Office Action issued Oct. 16, 2012 from TW counterpart application No. 098104425 cites TW 465812 (also published as US20010045912 A1) and TW M249230 (also published as US 6762731).
English Abstract of Office Action issued Oct. 16, 2012 from TW counterpart application No. 098104425.
English Abstract of TW 465812 (also published as US20010045912 A1) and TW M249230 (also published as US 6762731).

* cited by examiner

*Primary Examiner* — Jacob Y Choi
*Assistant Examiner* — Hasan Islam
(74) *Attorney, Agent, or Firm* — WPAT, P.C.; Anthony King

(57) ABSTRACT

A dish antenna adjustment method is performed as follows. A dish antenna angle adjustment apparatus is provided; the dish antenna angle adjustment apparatus having a base member, a first rotation member and a second rotation member. The first rotation member is pivotally connected to the second rotation member, and rotates by a first rotation angle relative to the second rotation member. The second rotation member is pivotally connected to the base member, and rotates by a second rotation angle relative to the base member. A first rotating angle adjustment mechanism is connected to the angle adjustment apparatus of the dish antenna, e.g., the first rotating angle adjustment mechanism connects the first rotation member and the second rotation member. The first rotating angle adjustment mechanism adjusts the first rotation angle between the first and second rotation members. The first rotating angle adjustment mechanism is detached from the angle adjustment apparatus, and the detached first rotating angle adjustment mechanism can be used for adjustment of another dish antenna.

9 Claims, 6 Drawing Sheets

ADJUSTMENT METHOD FOR DISH ANTENNA

BACKGROUND OF THE INVENTION (A) Field of the Invention

The present invention is related to a dish antenna, and more specifically, to an adjustment method for a dish antenna.

(B) Description of Related Art

A satellite television system employs a dish antenna to collect satellite signals, and the signals are then reflected to low noise block down converters (LNB) equipped at the focus of the dish antenna for amplifying the signals and reducing their frequencies down to around 1 GHz, i.e., the radio signals are transformed to an intermediate frequency. The adjusted signals are transmitted via a cable to an indoor television channel selector for selecting the signals of a desired channel, and the selected signals are then amplified, modulated and converted into video and audio signals for television viewing.

A dish antenna is a highly directional receiving device, which has to be precisely directed toward satellites in orbit at 36,000 kilometers altitude. For example, if a dish antenna with a 180 cm diameter shifts 2 cm horizontally, or 3 cm vertically, the signals will become weak or even disappear. In addition, if a dish antenna uses the Ka band, i.e., 26-40 GHz, an adjustment accuracy of 0.1 degrees is needed, and the tolerance has to be within 0.02 degrees for aiming at satellites precisely.

Normally, a dish antenna using the Ka band is adjusted by using a programmable logic controller (PLC) in control of servo motors; however, the high cost significantly limits its popularity.

FIG. 1 illustrates a known adjustable antenna apparatus 1 including a dish antenna 10, an LNB 11, a support rod 12, an adjustable dish bracket 13 and an adjustable base member 14. When the adjustable antenna apparatus 1 is disposed in different manners by securing the adjustable base member 14 at different places such as a vertical wall surface or a horizontal or inclined roof, the adjustable dish bracket 13 is used for adjusting the orientation of the dish antenna 10 to obtain optimal signal-reception performance. However, the adjustable dish bracket 13 only roughly adjusts the angle or fixing position of the dish antenna 10 according to the scale thereof, and obviously the dish antenna 10 cannot be fine-tuned within a precision smaller than the scale. In other words, the dish antenna 10 cannot be easily adjusted to an optimal angle or a fixing position.

Moreover, the dish antenna 10 is fixed after being adjusted, and there is no need for further adjustment. Accordingly, the adjusting mechanism is used only one time and is not cost-effective.

SUMMARY OF THE INVENTION

The present invention provides an adjustment method for a dish antenna, in which the related rotating angle adjustment mechanism can be reused, so as to effectively reduce the assembly cost for the dish antenna.

In accordance with an embodiment of the present invention, an adjustment method for a dish antenna includes the steps of (1) providing an angle adjustment apparatus for the dish antenna, the angle adjustment apparatus including a base member, a first rotation member and a second rotation member, wherein the first rotation member is secured to the second rotation member and can rotate by a first rotation angle relative to the second rotation member, the second rotation member is secured to the base member and can rotate by a second rotation angle relative to the base member; (2) connecting a first rotating angle adjustment mechanism and/or a second rotating angle adjustment mechanism to the angle adjustment apparatus, wherein the first rotating angle adjustment mechanism connects the first rotation member and the second rotation member, and the second rotating angle adjustment mechanism connects the second rotation member and the base member; (3) adjusting a first rotation angle between the first rotation member and the second rotation member by using the first rotating angle adjustment mechanism, and/or adjusting a second rotation angle between the second rotation member and the base member by using the second rotating angle adjustment mechanism; and (4) detaching the first rotating angle adjustment mechanism and/or the second rotating angle adjustment mechanism from the angle adjustment apparatus for use with another dish antenna.

DETAILED DESCRIPTION OF THE INVENTION

Figure 1:
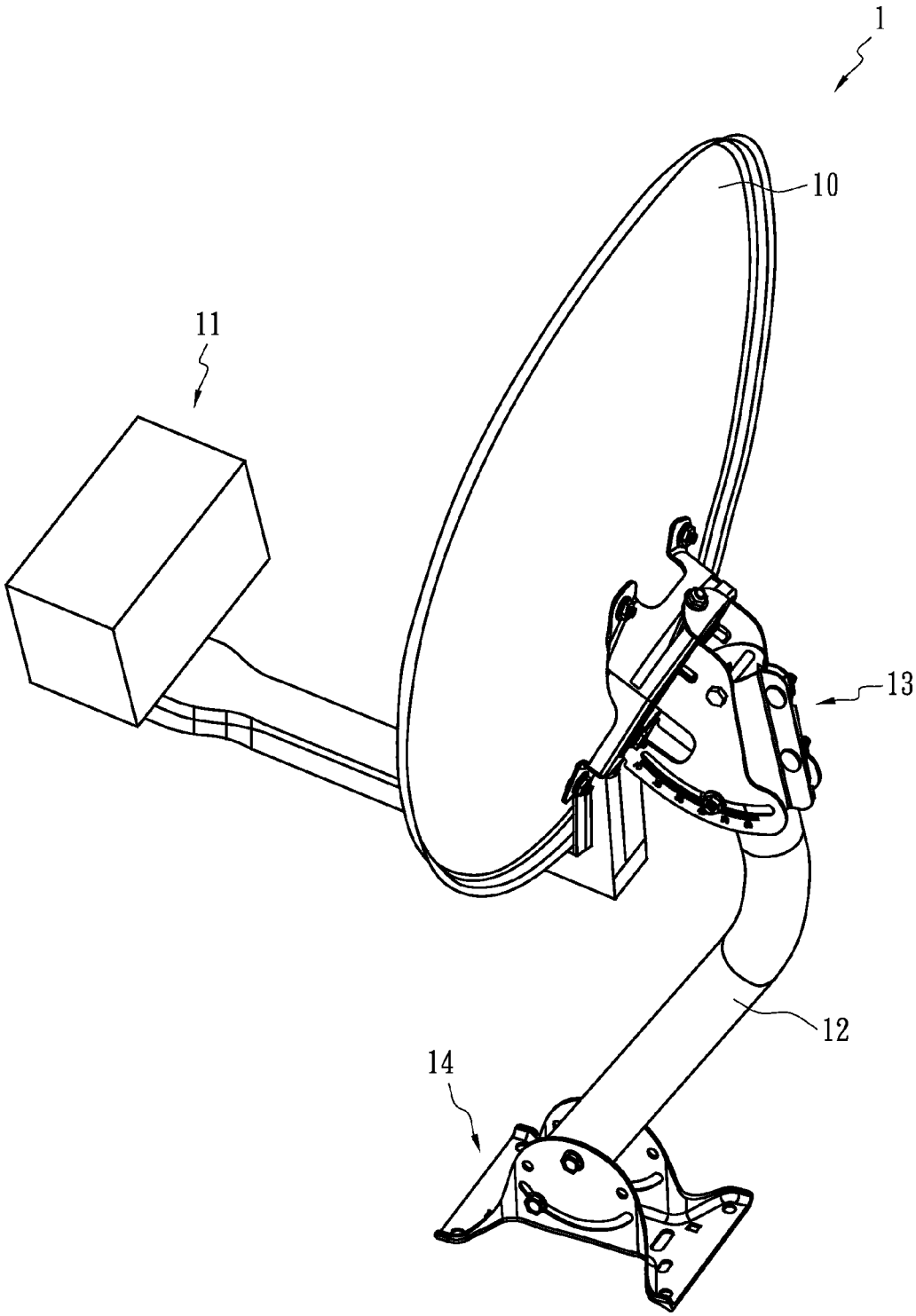
FIG. 1 (Prior Art)
FIG. 1 shows a known adjustable antenna apparatus.
Figure 2:
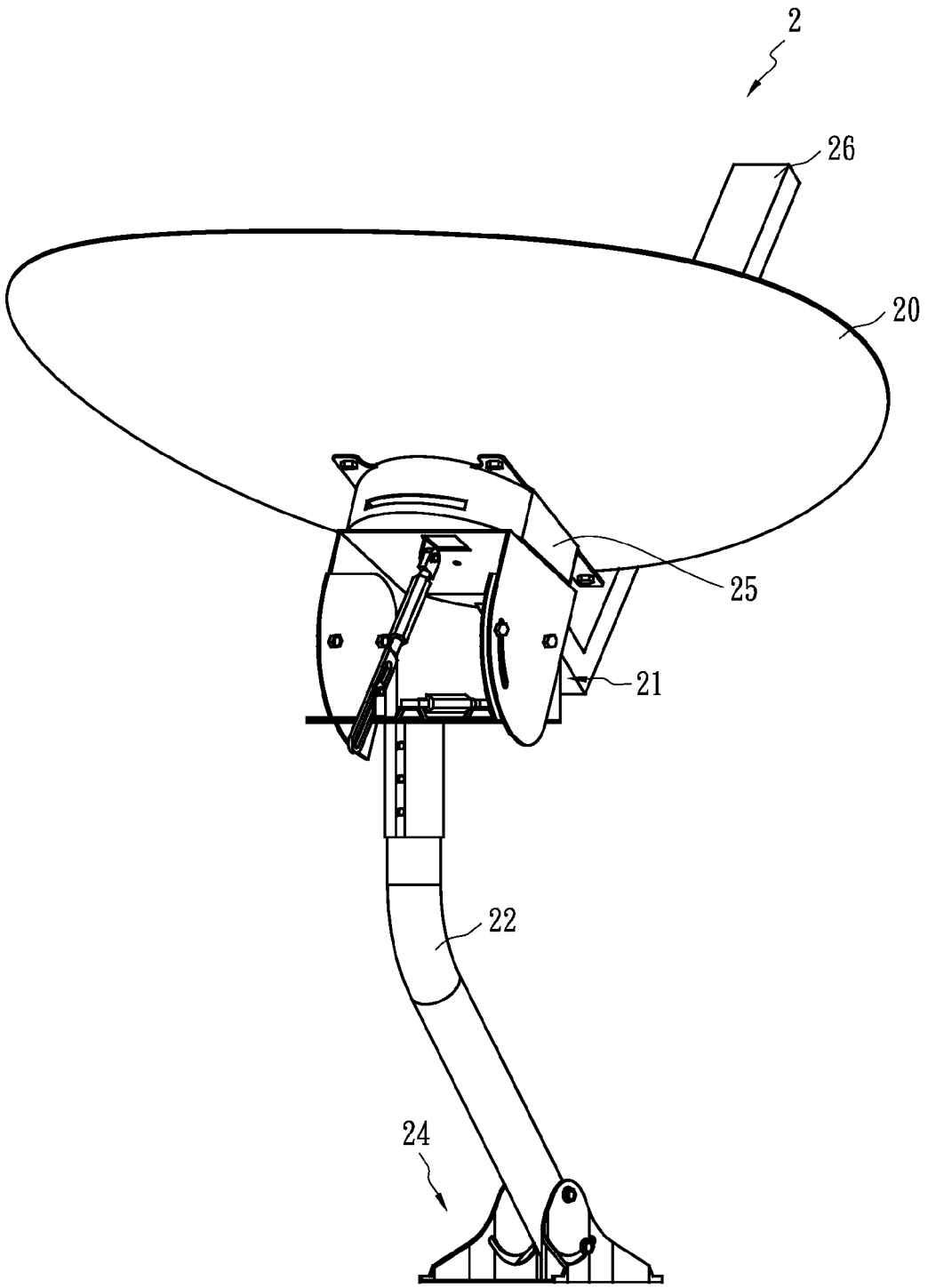
FIG. 2 shows a dish antenna apparatus in accordance with an embodiment of the present invention.

FIG. 2 shows a three-dimensional view of a dish antenna apparatus according to an embodiment of the present invention. A dish antenna apparatus 2 includes a dish antenna 20, an angle adjustment apparatus 21, a support rod 22 and an adjustable base member 24. The dish antenna 20 is secured to the angle adjustment apparatus 21 by a dish bracket 25, and the angle adjustment apparatus 21 is configured to adjust the angles of the dish antenna 20 in two directions which are approximately perpendicular to each other. An LNB rod 26 is secured to a side of the dish bracket 25. The support rod 22 connects the angle adjustment apparatus 21 and the adjustable base member 24. The dish antenna apparatus 2 can be disposed in different manners by securing the adjustable base member 24 at different places such as a vertical wall surface or a horizontal or inclined roof, and the angle adjustment apparatus 21 can adjust the orientation of the dish antenna 20 for obtaining optimal transmission performance.

Figure 3:
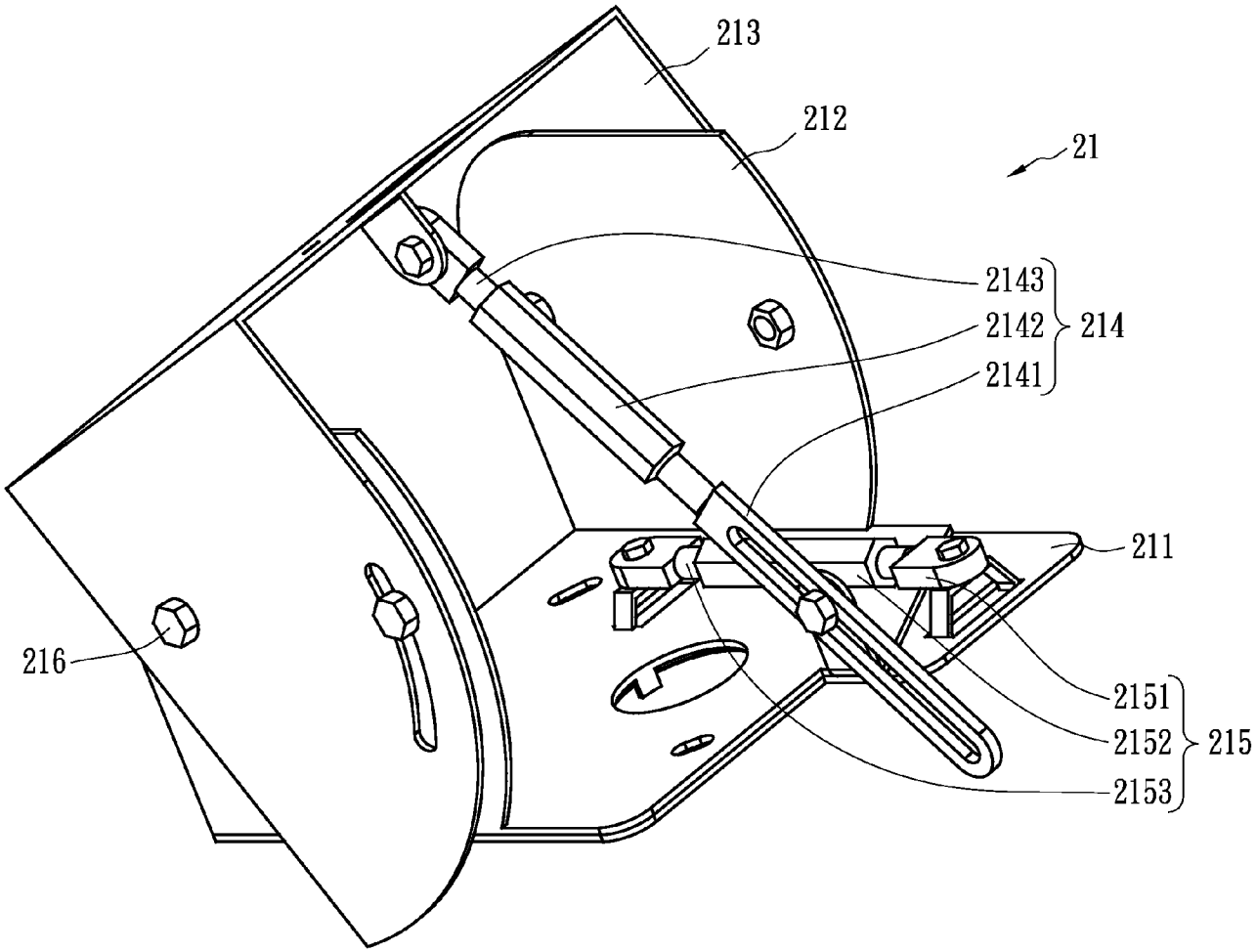
FIG. 3 shows an angle adjustment apparatus of the present invention.

FIG. 3 shows the three-dimensional view of an angle adjustment apparatus in accordance with the present invention. The angle adjustment apparatus 21 includes a base member 211, a first rotation member 213, a second rotation member 212, a first rotating angle adjustment mechanism 214 and a second rotating angle adjustment mechanism 215. The first rotation member 213 is secured to the second rotation member 212, and is capable of rotating by a first rotation angle relative to the second rotation member 212. The second rotation member 212 is secured to the base member 211, and is capable of rotating by a second rotation angle relative to the base member 211. More specifically, the second rotation member 212 rotates along a pivot perpendicular to the base member 211. The second rotating angle adjustment mechanism 215 includes a screw 2151, a screw 2153 and a screw nut 2152. The ends of the screws 2151 and 2153 distal from each other are pivotally connected to the base member 211 and the second rotation member 212, and the other ends of the screws 2151 and 2153 near to each other have threads which are engaged with the screw nut 2152.

Figure 4A:
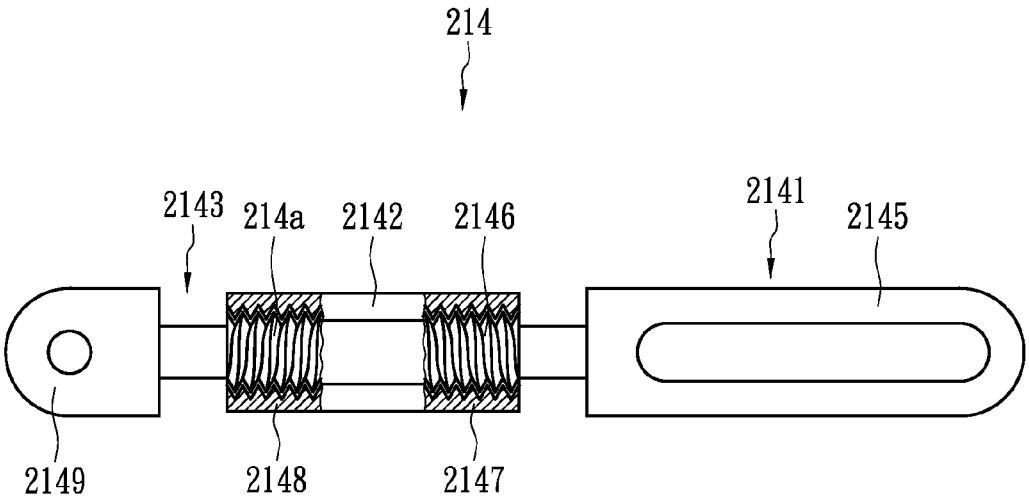
FIG. 4A shows a first rotating angle adjustment mechanism in accordance with the present invention.

As shown in FIGS. 3 and 4A, the first rotating angle adjustment mechanism 214 includes a first screw 2141, a screw nut 2142 and a second screw 2143. An end 2145 of the first screw 2141 is pivotally connected to second rotation member 212, and another end has a first thread 2146 that is engaged with a first inner thread 2147 of the screw nut 2142. An end 2149 of the second screw 2143 is pivotally connected to the first rotation member 213, and another end has a second thread 214*a* that is engaged with the second inner thread 2148 of the screw nut 2142. The first thread 2146 (or the first inner thread 2147) and the second thread 214*a* (or the second inner thread 2148) have opposite thread directions such as left-hand thread or right-hand thread.

When the end 2145 of the first screw 2141 and the second rotation member 212 are fixed, the relative angle between the second rotation member 212 and the first rotation member 213 can be fine-tuned by rotating the screw nut 2142. Because the threads are of different thread directions, the first screw 2141 and the second screw 2143 approach or depart from the screw nut 2142 as the screw nut 2142 is rotated. Accordingly, the second rotation member 212 and the first rotation member 213 move in relative motion around a pivot 216 (see FIG. 3).

Likewise, the screws 2151, 2153 and the screw nut 2152 of the second rotating angle adjustment mechanism 215 have equivalent or similar structures. Accordingly, the second rotation member 212 can rotate clockwise or counterclockwise relative to the base member 211. When the second rotating angle adjustment mechanism 215 extends, the second rotation member 212 rotates counterclockwise relative to the base member 211. In contrast, when the second rotating angle adjustment mechanism 215 extracts, the second rotation member 212 rotates clockwise relative to the base member 211.

Figure 4B:
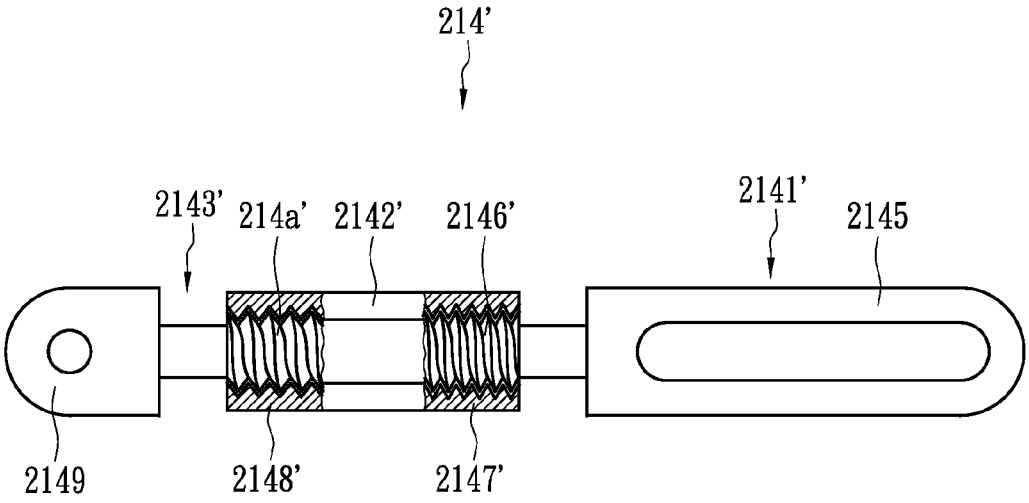
FIG. 4B shows another first rotating angle adjustment mechanism in accordance with the present invention.

FIG. 4B shows another first rotating angle adjustment mechanism of the present invention. The first thread 2146' and the second thread 214*a*' of the first rotating angle adjustment mechanism 214' rotate in the same direction but with different pitches; thus the first screw 2141' and the second screw 2143' generate relative motion when the screw nut 2142 is rotated. In other words, the relative moving speed of the first screw 2141' and the screw nut 2142' is different from that of the second screw 2143' and the screw nut 2142.' The difference of the relative moving speeds generates the mechanism of fine-tuning the first rotating angle.

Figure 5:
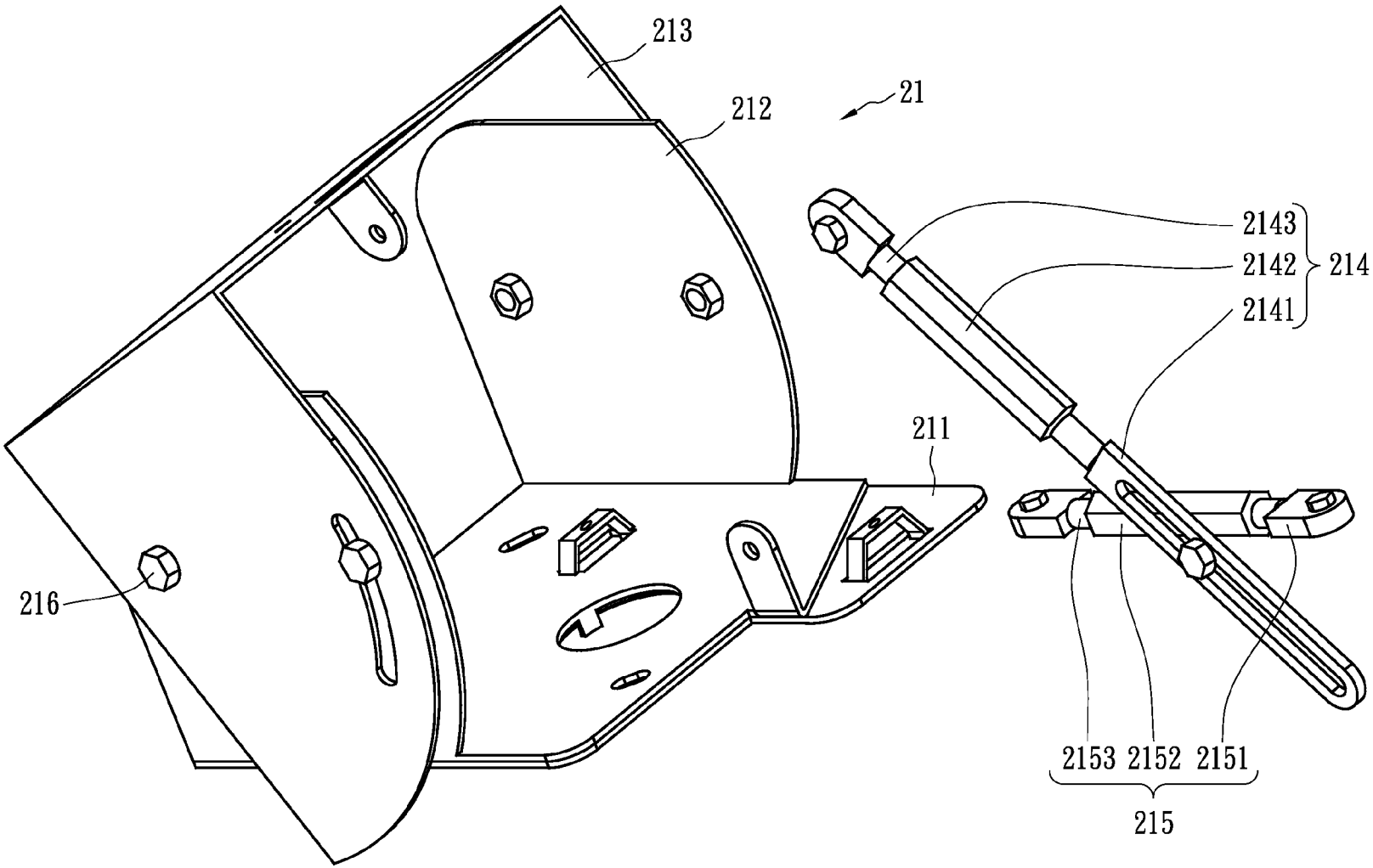
FIG. 5 shows the detached rotating angle adjustment mechanisms, the rotation members and the base member in accordance with the present invention.

Because the dish antenna usually needs not to be further adjusted after the adjustment is completed, the first rotating angle adjustment mechanism 214 and the second rotating angle adjustment mechanism 215 no longer provide any function after adjustment. In this embodiment, the two ends of the first rotating angle adjustment mechanism 214 and the second rotating angle adjustment mechanism 215 are detachable. After the first rotating angle adjustment mechanism 214 and the second rotating angle adjustment mechanism 215 adjust the angles of the dish antenna, the first rotating angle adjustment mechanism 214 and the second rotating angle adjustment mechanism 215 can be detached from the angle adjustment apparatus 21 of the dish antenna 20, i.e., the first rotating angle adjustment mechanism 214, the second rotating angle adjustment mechanism 215 and the angle adjustment apparatus 21 are disassembled, as shown in FIG. 5. Then, the detached first rotating angle adjustment mechanism 214 and the second rotating angle adjustment mechanism 215 can be attached to another angle adjustment apparatus, so as to adjust the rotation angles of another dish antenna.

Because the elevation angle of a dish antenna of a directional satellite is more important than the horizontal angle thereof, some dish antennas only have the first rotating angle adjustment mechanism. In an embodiment, a rotating angle adjustment mechanism that can adjust both the first rotation angle and the second rotation angle is employed. For example, the lengths of the rotating angle adjustment mechanism connecting to the angle adjustment apparatus at different places are designed to be the same. After the first rotation angle is adjusted, the rotating angle adjustment mechanism is disassembled and reassembled to another corresponding place for adjusting the second rotation angle.

Figure 6:
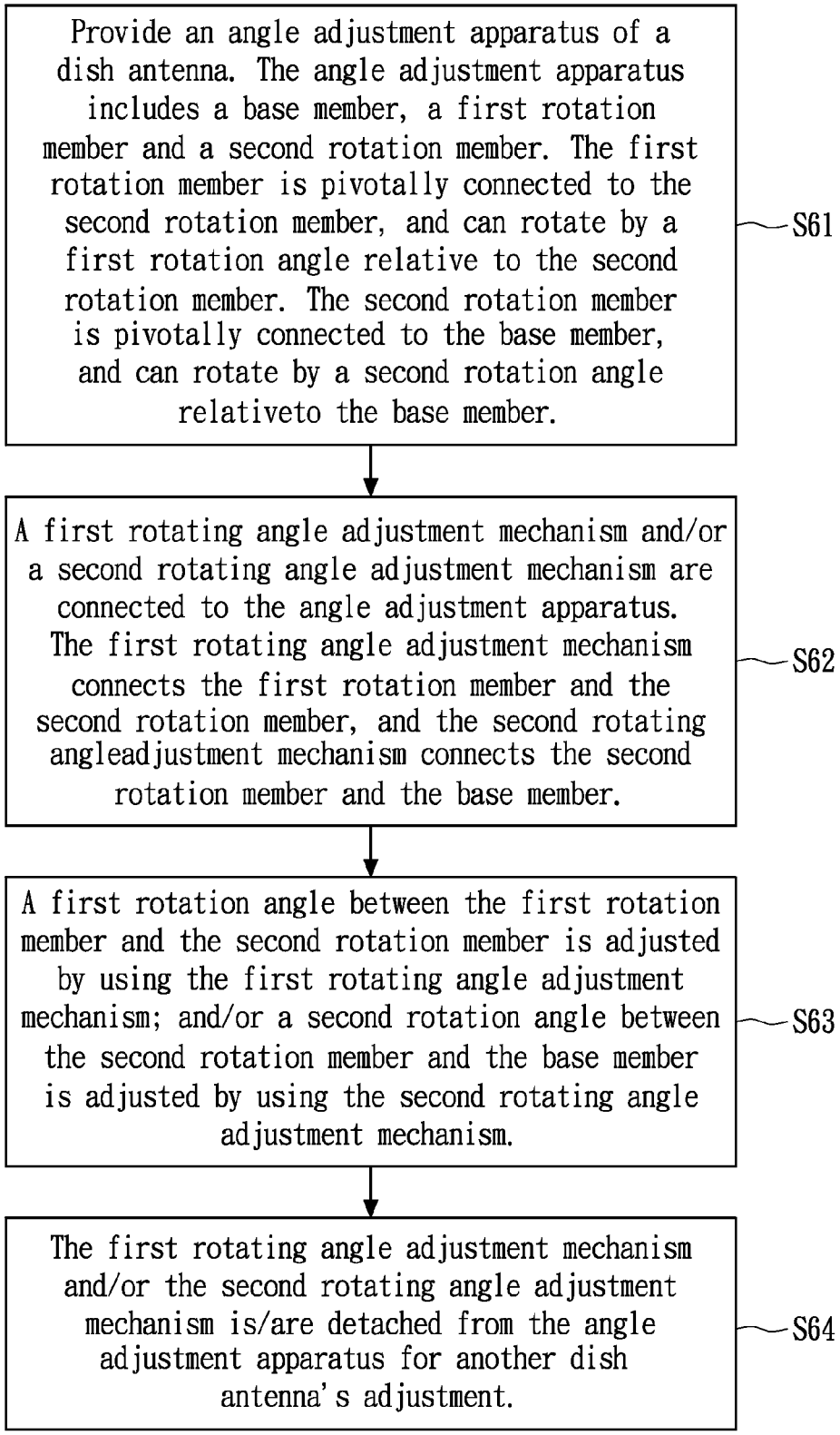
FIG. 6 is a flow chart of the adjustment method for a dish antenna in accordance with the present invention.

In view of the above, the adjustment method of a dish antenna is shown in FIG. 6. In step S61, an angle adjustment apparatus of a dish antenna is provided, and the angle adjustment apparatus includes a base member, a first rotation member and a second rotation member. The first rotation member is pivotally connected to the second rotation member, and can rotate by a first rotation angle relative to the second rotation member. The second rotation member is pivotally connected to the base member, and can rotate by a second rotation angle relative to the base member. In step S62, a first rotating angle adjustment mechanism and/or a second rotating angle adjustment mechanism are connected to the angle adjustment apparatus. The first rotating angle adjustment mechanism connects the first rotation member and the second rotation member, and the second rotating angle adjustment mechanism connects the second rotation member and the base member. In step S63, a first rotation angle between the first rotation member and the second rotation member is adjusted by using the first rotating angle adjustment mechanism; and/or a second rotation angle between the second rotation member and the base member is adjusted by using the second rotating angle adjustment mechanism. In step S64, the first rotating angle adjustment mechanism and/or the second rotating angle adjustment mechanism is/are detached from the angle adjustment apparatus for another dish antenna's adjustment.

The above-described embodiments of the present invention are intended to be illustrative only. Numerous alternative embodiments may be devised by those skilled in the art without departing from the scope of the following claims.

What is claimed is:

1. An adjustment method for a dish antenna, comprising:

providing an angle adjustment apparatus of the dish antenna, the angle adjustment apparatus comprising a base member, a first rotation member and a second rotation member, wherein the first rotation member is pivotally connected to the second rotation member and can rotate by a first rotation angle relative to the second rotation member, and the second rotation member is pivotally connected to the base member and can rotate by a second rotation angle relative to the base member;

connecting a first rotating angle adjustment mechanism to the angle adjustment apparatus, wherein the first rotating angle adjustment mechanism connects the first rotation member and the second rotation member;

adjusting the first rotation angle between the first rotation member and the second rotation member by using the first rotating angle adjustment mechanism;

detaching the first rotating angle adjustment mechanism from the angle adjustment apparatus; and assembling the detached first rotating angle adjustment mechanism to an angle adjustment apparatus of another dish antenna for adjusting a first rotation angle of the another dish antenna.

2. The adjustment method for a dish antenna of claim 1, further comprising a step of assembling the detached first rotating angle adjustment mechanism to the second rotation member and the base member for adjusting the second rotation angle.

3. The adjustment method for a dish antenna of claim 1, wherein the first rotating angle adjustment mechanism comprises:

a screw nut;

a first screw of which one end is pivotally connected to the first rotation member and another end has a first thread engaged with the screw nut; and a second screw of which one end is pivotally connected to the second rotation member and another end has a second thread engaged with the screw nut;

wherein the first thread and the second thread have either different thread directions or a same thread direction with different pitches.

4. The adjustment method for a dish antenna of claim 1, further comprising the steps of:

connecting a second rotating angle adjustment mechanism to the angle adjustment apparatus, wherein the second rotating angle adjustment mechanism connects the base member and the second rotation member;

adjusting the second rotation angle between the base member and the second rotation member by using the second rotating angle adjustment mechanism; and detaching the second rotating angle adjustment mechanism from the angle adjustment apparatus.

5. The adjustment method for a dish antenna of claim 4, further comprising a step of attaching the detached second rotating angle adjustment mechanism to another dish antenna to adjust the second rotation angle of another dish antenna.

6. The adjustment method for a dish antenna of claim 4, wherein the second rotating angle adjustment mechanism comprises two screws and a screw nut, the ends of the two screws distal from each other are pivotally connected to the base member and the second rotation member, and other ends of the two screws near to each other have different threads and are engaged with the screw nut.

7. The adjustment method for a dish antenna of claim 6, wherein the two screws of the second rotating angle adjustment mechanism have either different thread directions or a same thread direction with different pitches.

8. The adjustment method for a dish antenna of claim 1, wherein the first rotation angle and the second rotation angle are perpendicular to each other.

9. The adjustment method for a dish antenna of claim 1, wherein the first rotation member and the second rotation member are connected to a pivot.

* * * * *